US006995638B1

(12) United States Patent
Smith et al.

(10) Patent No.: US 6,995,638 B1
(45) Date of Patent: Feb. 7, 2006

(54) STRUCTURAL AUGMENTATION FOR FLEXIBLE CONNECTOR

(75) Inventors: Bradley M. Smith, Mount Laurel, NJ (US); Mark C. Newkirk, Moorestown, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 103 days.

(21) Appl. No.: 10/746,768

(22) Filed: Dec. 24, 2003

(51) Int. Cl.
*H01P 1/06* (2006.01)

(52) U.S. Cl. ..... 333/256; 333/248; 343/765

(58) Field of Classification Search ..... 333/241, 333/248, 256; 343/757, 758, 761, 765
See application file for complete search history.

(56) References Cited

U.S. PATENT DOCUMENTS

| | | | | |
|---|---|---|---|---|
| 2,472,824 | A * | 6/1949 | Hays, Jr. | 307/149 |
| 2,956,248 | A * | 10/1960 | Strand | 333/241 |
| 4,647,884 | A * | 3/1987 | Lang et al. | 333/248 |
| 4,786,913 | A * | 11/1988 | Barendregt et al. | 343/765 |
| 6,870,512 | B2 * | 3/2005 | Yoneda et al. | 343/781 CA |

* cited by examiner

*Primary Examiner*—Dean Takaoka
(74) *Attorney, Agent, or Firm*—Duane Morris LLP

(57) ABSTRACT

A flexible connection extending between two objects which have relative motion is subject to deleterious electrical performance or damage due to fatigue or resonance. The connection is structurally augmented and therefore stiffened without affecting the range of motion by use of one of a pantograph or a bell-crank-and-carriage stiffener arrangement. The structural augmentation connects to the ends of the connection and also to locations along the length, to force portions of the connection to accept motion proportional to their distance between the moving ends.

13 Claims, 15 Drawing Sheets

OBTUSE ANGLE BELL CRANK

BELL CRANK, WITH ONE END STILL
(PULL OTHER END, MIDDLE MOVES PROPORTIONALLY)

STRUCTURAL AUGMENTATION FOR FLEXIBLE CONNECTOR

FIELD OF THE INVENTION

This invention relates to flexible connections which extend between objects which have relative motion, and also relates to methods for enhancing the reliability and resonances of such connections.

BACKGROUND OF THE INVENTION

There is a certain class of radars that feature a transmitter (and associated equipments) separated from, but connected to, the antenna. With increased emphasis being placed on the costs of such equipment, it has become common to use commercial off-the-shelf (COTS) equipment wherever possible. Consequently, the radar transmitter may be built using COTS. However, COTS equipment is generally more fragile than militarized equipment, and may be subject to failure in severe environments. For protection against severe acceleration or vibration, COTS-equipped transmitters may be mounted on a mechanical isolation system, which attenuates severe acceleration by transforming accelerations into large deflections. As a result, significant motion can be expected between the transmitter and the associated antenna, which must be accommodated.

In a radar context, relatively large amounts of radio-frequency (RF) energy are involved, and low losses are desirable. Such requirements suggest the use of "transmission lines," which are conductor arrangements which exhibit controlled surge resistance or "characteristic impedance." Most often, the characteristic impedance remains constant throughout the length of the transmission line, but transmission lines with varying impedance are known. One of the types of transmission line often used with radar systems is "waveguide," of which many forms are known, including "circular" and "rectangular." A circular or rectangular waveguide takes the form of a hollow tube of electrically conductive material having a circular or rectangular cross-sectional shape. Such waveguides may be "rigid" (self-supporting), typically made from thick-wall aluminum, or "flexible," typically made from corrugated thin-wall copper-alloy material. In this context, "flexible" means that the waveguide deforms significantly under its own weight. The flexible waveguides are sometimes known as "flexguide."

FIG. 1*a* illustrates a mechanical system 10 including an antenna illustrated as a block 12 with a radiating face 12*rf*, a transmitter (TX) illustrated as a block 14, and a flexible rectangular waveguide 16 extending therebetween. Waveguide 16 is fastened to a flange 14*f*, which in turn is fastened to a mating location on antenna 12. A similar flange (not visible in FIG. 1*a*) fastens the other end of waveguide 16 to a mating portion of transmitter block 14. In this context, it should be understood that the term "between" is used in its electrical sense, rather than in its mechanical or location sense. FIG. 1*b* illustrates the same structure as that of FIG. 1*a*, but shows the flexible waveguide 26 as extending between blocks 12 and 14 and making attachment by a flange 26*f* to block 14, but not lying physically between the blocks 12 and 14. In its electrical sense, the term "between" means that there is an electrical energy transmission path (or signals are coupled) from one of the blocks to the other, and possibly bidirectionally.

The purpose of the waveguide is to provide an electrically stable energy transmission path from the transmitter to the antenna. The reason for using flexible waveguide in FIGS. 1*a* and 1*b* rather than rigid waveguide is to accommodate or "take up" the relative motion between the transmitter and the antenna. Ideally, the waveguide would exhibit constant loading-to-stiffness ratio along its length. When a length of flexible waveguide extends between objects in relative motion, such as the transmitter and antenna of FIGS. 1*a* and 1*b*, a simplistic assumption is that the waveguide will flex uniformly along its length, thereby distributing the bending or deformation associated with the motion. Unfortunately, slight variations in manufacture of the waveguide will result in greater rigidity of some portions of the guide than at other portions. Consequently, bending will take place preferentially at certain locations. Thus, the bending associated with the relative motion, rather than being distributed uniformly along the length of the transmission line, tends to occur at specific locations, and may have deleterious electrical effects at such locations, such as electrical phase and impedance changes. Also, it is well known that repeated flexing or bending of a metallic object at a particular location tends to work harden or crystallize the metal, and ultimately results in cracks and failure. This form of failure is known as "fatigue failure." Fatigue failure is exacerbated if the waveguide structure is resonant in a range of frequencies which includes the input excitation frequency, because the amount of motion becomes amplified with respect to the applied excitation. It is difficult to design a waveguide for such purposes which satisfies both the need for a limber structure for good range of motion and the stiffness required for good fatigue life.

Improved electrical connection arrangements are desired.

SUMMARY OF THE INVENTION

A mechanical system according to an aspect of the invention comprises first and second separate objects. The first and second objects are subject to recurrent relative motion therebetween. In one embodiment of this aspect of the invention, the first and second objects are a transmitter and an antenna, respectively. A flexible connection, which in one embodiment is a rectangular waveguide connection, includes a first end physically connected to the first object and a second end physically connected to the second object. The flexible connection or waveguide is subject to failure due to fatigue attributable to the recurrent motion or due to mechanical resonance within the range of frequencies of the excitation. The mechanical system includes one of (a) a pantograph and (b) a bell-crank-and-carriage arrangement. The one of the pantograph and a bell-crank-and-carriage arrangements includes a first end physically connected to the first object and a second end physically connected to the second object. The one of the pantograph and a bell-crank-and-carriage arrangements also includes an attachment portion exhibiting a motion intermediate the relative motion. The mechanical system also includes a physical connection between the attachment portion of the one of the pantograph and a bell-crank-and-carriage arrangements and the exterior of the middle of the flexible connection or waveguide connection.

In a particular version of one aspect of the invention, the first and second separate objects are independently supported, and the one of the pantograph and bell-crank-and-carriage arrangements does not support either object.

In one embodiment of this aspect of the invention, the attachment portion lies approximately midway between the first and second ends.

DESCRIPTION OF THE INVENTION

Figure 1A:
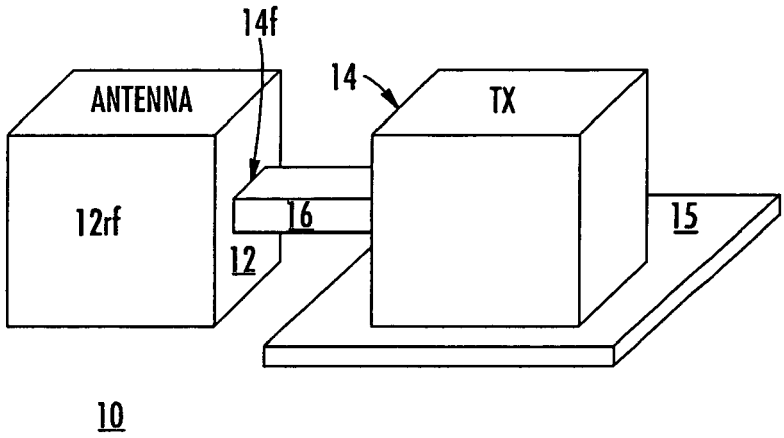
FIG. 1*a* is a simplified perspective or isometric view of a waveguide extending between two objects subject to relative motion.
Figure 1B:
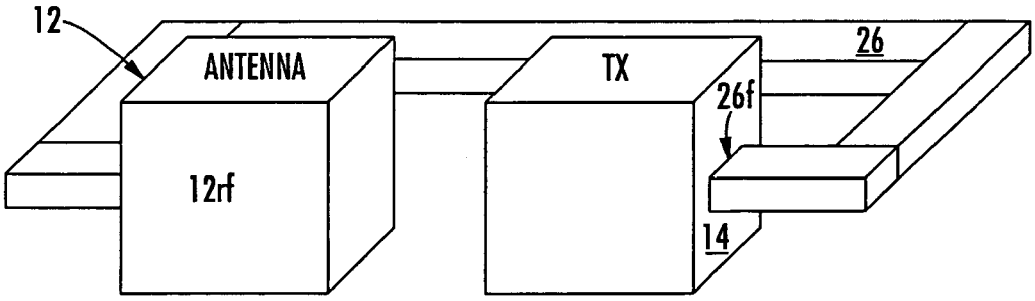
FIG. 1*b* shows an alternative electrical connection between the objects.
Figure 2A:
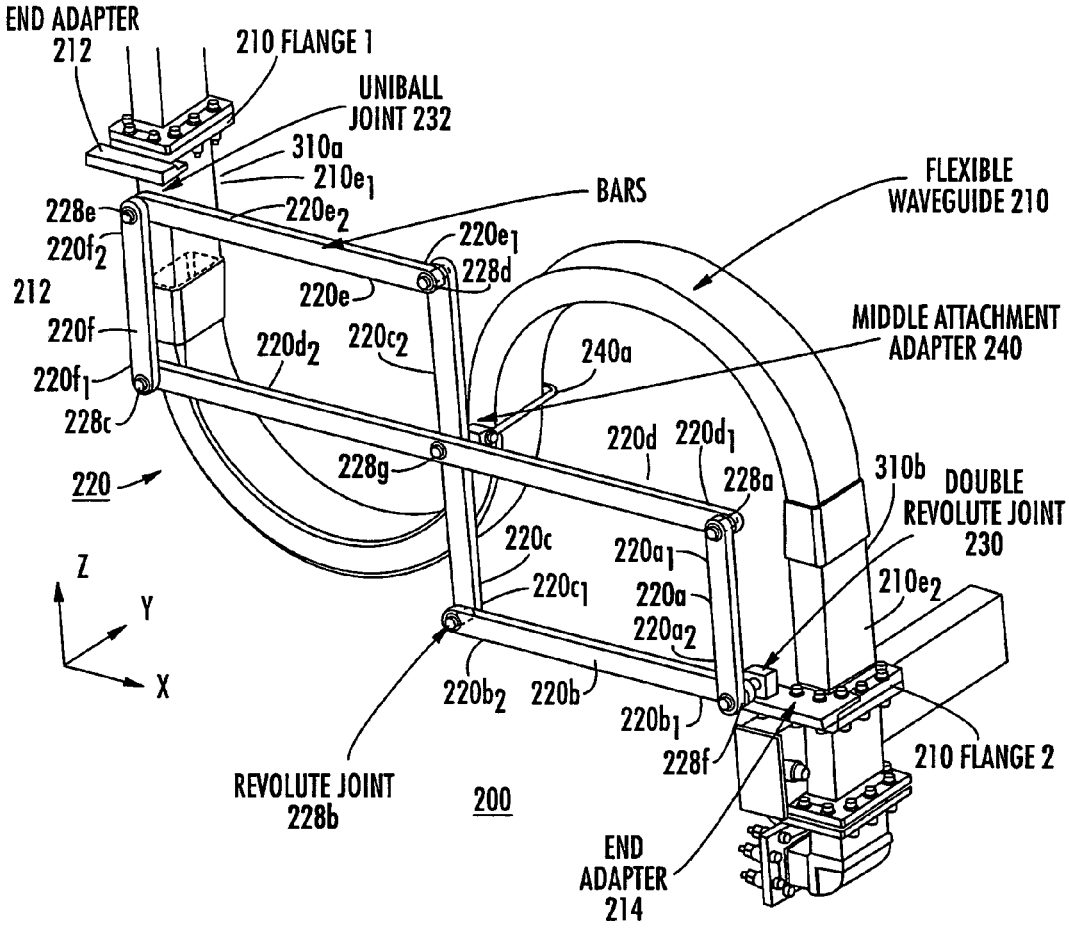
FIG. 2*a* is a simplified perspective or isometric view of a waveguide extending between two locations which are in relative motion, with a pantograph affixed for stabilizing the waveguide.

In FIG. 2*a*, an arrangement 200 includes a flexible rectangular waveguide 210 which is formed into a sinuous "S" shape. Flexible waveguide 210 also includes rigid end portions. Waveguide 210 has a first end 210*e*1 connected to an end adapter 212 by way of a flange 210flange1 and also has a second end 210*e*2 connected by way of a flange 210flange2 to a second end adapter 214. End adapters 212 and 214 may be considered to be rigidly affixed to the first and second objects, such as objects 12 and 14 of FIG. 1*a*, which are subject to relative motion therebetween. According to an aspect of the invention, additional structure is added to arrangement 200 of FIG. 2*a* to constrain the motion of the waveguide 210. More specifically, the additional structure is a mechanism with bars and rotating joints which structurally augments the stiffness of the flexible waveguide in a specific manner. The mechanism attaches to the ends and the middle of the waveguide and raises the mechanical resonant frequency of the waveguide by changing its response modes. In the specific application, the resonant frequency of the waveguide was raised above the range of frequencies of the relative motion. This, in turn, tends to reduce flexing of the waveguide occurring during the time of the mechanical excitation. In addition, the center of the waveguide is constrained to move so as to remain half-way between the ends, which in effect forces the waveguide bending attributable to the relative motion to be distributed between the two halves, or among the (three or more) sections for those embodiments (not illustrated) in which the auxiliary support structure is affixed at plural locations along the waveguide.

Figure 2B:
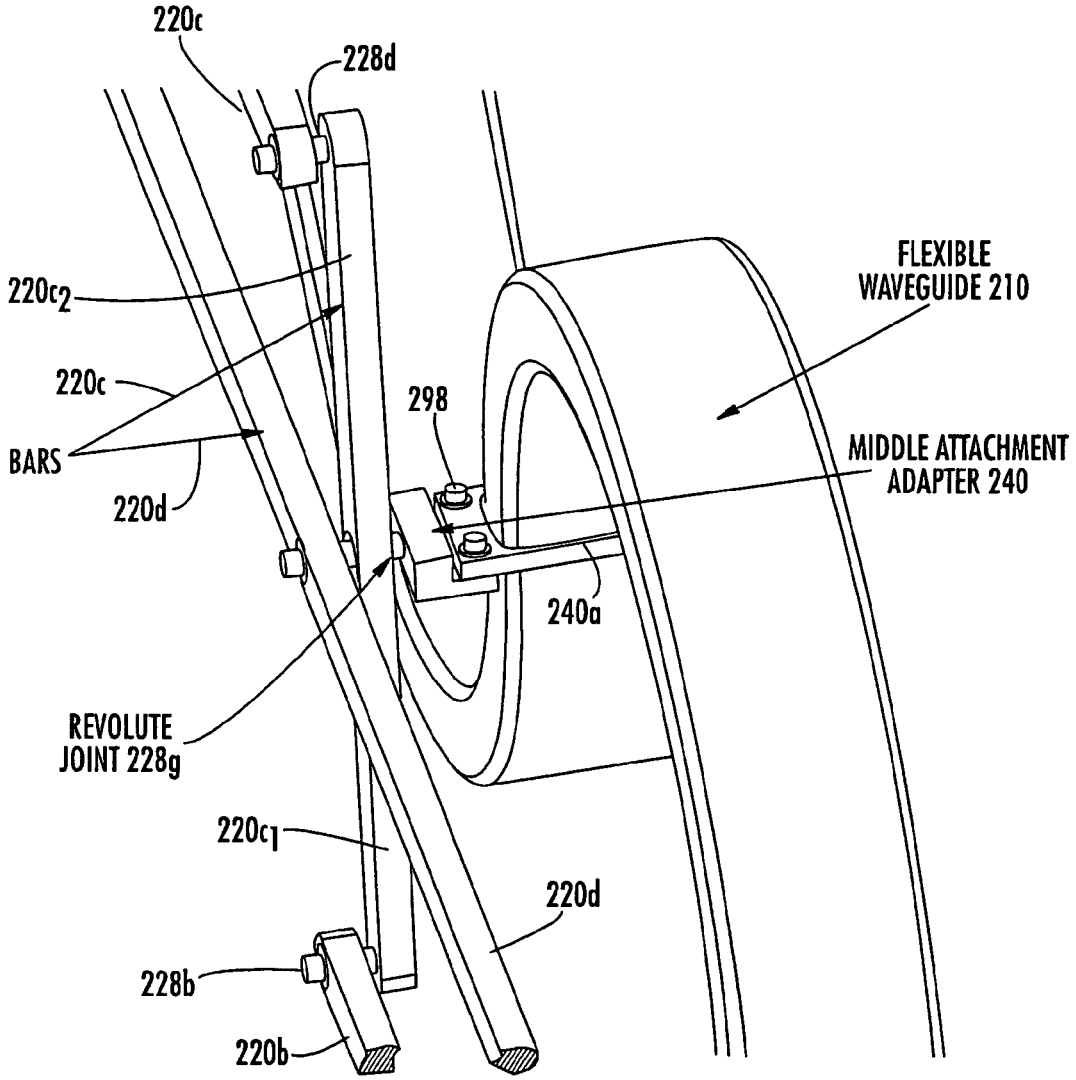
FIG. 2*b* is a detail illustrating portions of the structure of FIG. 2*a;*

In FIGS. 2*a* and 2*b*, a pantograph designated generally as 220 includes elongated bars or members 220*a*, 220*b*, 220*c*, 220*d*, 220*e*, and 220*f*. An end 220*a*2 of bar 220*a* is connected by a single revolute joint 228*f* to an end 220*b*1 of bar 220*b*, and the other end 220*a*1 of bar 220*a* is connected by a single revolute joint 228*a* to end 220*d*1 of bar 220*d*. A second end 220*b*2 of bar 220*b* is connected by a single revolute joint 228*b* to an end 220*c*1 of bar 220*c*. A second end 220*d*2 of bar 220*d* is connected by a single revolute joint 228*c* to an end 220*f*1 of bar 220*f*. A second end 220*c*2 of bar 220*c* is connected by a single revolute joint 228*d* to an end 220*e*1 of bar 220*e*. A second end 220*e*2 of bar 220*e* is connected by a single revolute joint 228*e* to end 220*f*2 of bar 220*f*. The centers of bars 220*c* and 220*d* are joined together by a single revolute joint 228*g*. All the bars join other bars of pantograph 220 with single revolute joints. For this purpose, a single revolute joint allows rotation only in one plane. An example of a single revolute joint is a ball bearing with a captured inner race, which provide smooth unresisted rotation as the inner race rotates within the outer race. This joint provides one degree of freedom, so the joint as a whole is capable of motion in only a single plane, which is to say that it can lengthen and contract along a line joining joints 228*e* and 228*f*, but (except for bending of the elements) cannot twist out of its plane. The use of single-revolute joints which join the bars to the flexible waveguide tend to force out-of-plane motion of the flexible waveguide to track or follow out-of-plane motion of the pantograph, and vice versa.

Figure 4A:
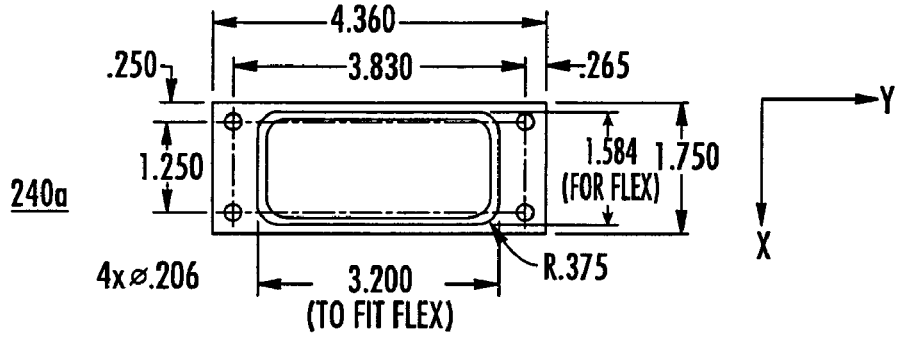
FIG. 4*a* is a plan view of a waveguide peripheral adapter of FIG. 2*a*.
Figure 4B:
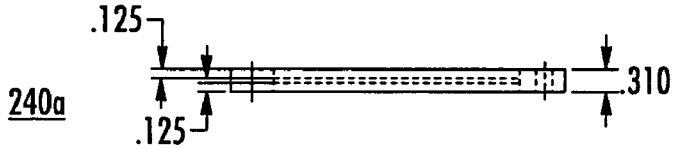
FIG. 4*b* is an elevation view thereof.

The pantograph 220 of FIGS. 2*a* and 2*b* has that end associated with single revolute joint 228*e* connected to end adapter 212 by way of a spherical or uniball joint, capable of rotational freedom of motion around three axes. This may be embodied as a simple steel ball with a hole therein, in a spherical inner race, with a threaded rod end. This allows motion around any axis (up to a certain point) but resists radial thrust. As mentioned, end adapter 212 may be viewed as being the physical attachment location for end 210*e*1 of waveguide 210 to the first object or block 12 of FIG. 1*a*. That end of pantograph 220 associated with single revolute joint 228*f* is connected to end adapter 214 by a double revolute joint, which provides freedom of motion about two orthogonal axes. End adapter 214 may be viewed as being the point of attachment of end 210*e*2 of waveguide 210 to the second object or block 14 of FIG. 1*a*. A double revolute joint is a combination of two revolute joints in mutually perpendicular axes, providing two degrees of freedom, as all other rotations and translations are resisted. Also, the center of the pantograph, corresponding to revolute joint 228*g* at the center of bars 220*c* and 220*d*, is connected by a pair of screws 298 to a middle attachment adapter 240 to a peripheral adapter 240*a*, details of which are illustrated in FIGS. 4*a* and 4*b*. Peripheral adapter 240*a* attaches at the center of the flexible waveguide 210, as measured between the ends 210*e*1 and 210*e*2, but does not actually connect inside the hollow waveguide structure, but rather around the periphery. With this arrangement, it will be clear that motion of either end of pantograph 220 (say the end associated with end adapter 212) relative to the other end (say the end associated with end adapter 214) in the XZ, plane will cause the center of the waveguide 210 to move in the same direction by one-half the travel. Constraining the peripheral adapter in this manner changes the response modes of the flexguide, thereby raising the resonant frequency of the waveguide, and forces both halves of the waveguide to accept or accommodate a portion of the motion, both of which tend to improve reliability.

Figure 3:
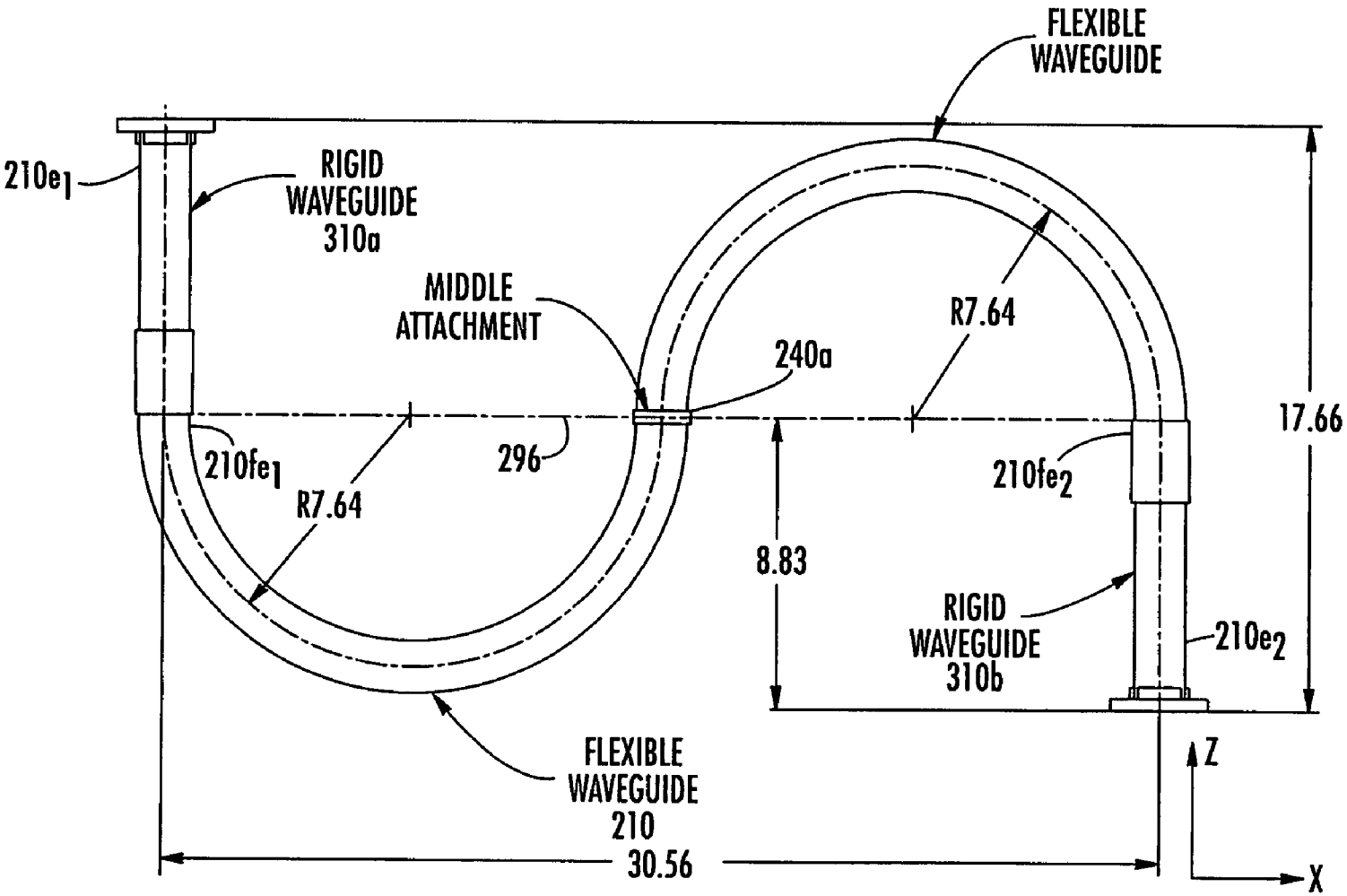
FIG. 3 is a simplified side elevation view of the flexible waveguide of FIG. 2*a* and some of its attachments.

FIG. 3 illustrates waveguide 210 of FIG. 2*a* in more detail. In FIG. 3, rigid waveguide portions associated with the ends 210*e*1 and 210*e*2 of flexible waveguide 210 are designated as 310*a* and 310*b*, respectively. Also visible in FIG. 3 is a portion 240*a* of middle attachment 240 of FIG. 2*a*. A dot-dash line 296 passes through middle attachment 240*a* and through the ends 210*fe*1 and 210*fe*2 of the flexible portions of flexible waveguide 210, to show that these three points lie in a straight line. FIGS. 4*a* and 4*b* are plan and cross-sectional views, respectively, of the attachment element 240*a* of FIG. 2*a*.

Pantograph 220 of FIG. 2*a* does three things; it accommodates the range of motion by providing the requisite degrees of freedom, it structurally augments the stiffness of the flexible waveguide by attaching near the middle, thereby changing the vibration response of the waveguide, ideally to a range above the range of frequencies of the excitation motion, and it provides three-dimensional motion for a point between the ends of the flexible waveguide, thereby minimizing stress at any location by improving the distribution of the stress throughout the structure. The pantograph does this by providing stiffness only where needed.

Figure 5A:
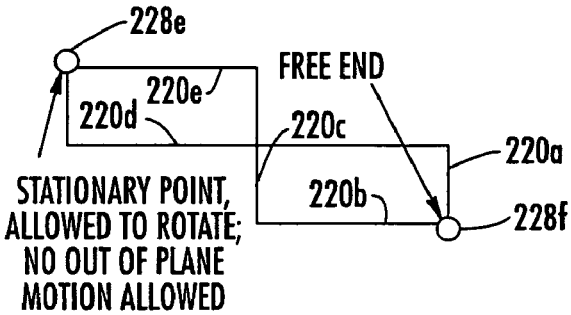
FIGS. 5*a*, 5*b*, and 5*c* illustrate some motions of which the structure of FIG. 2*a* is capable.
Figure 5B:
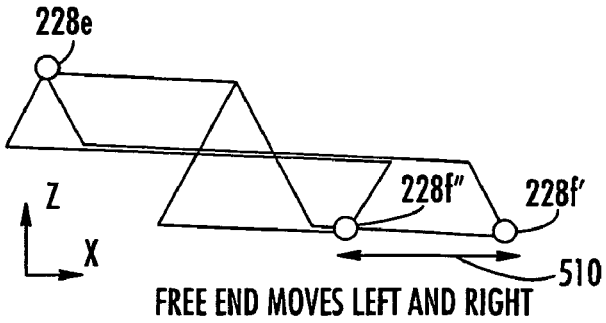
Figure 5C:
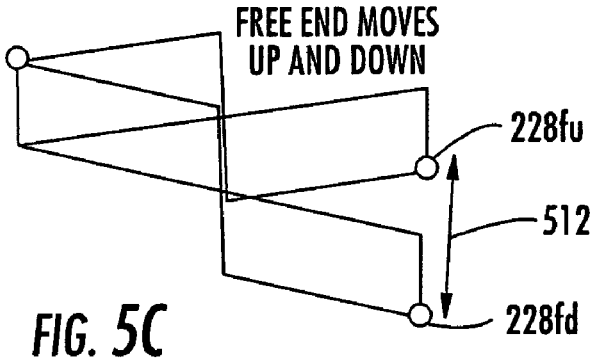

FIGS. 5*a*, 5*b*, and 5*c* together illustrate a range of pantograph motions in two dimensions. In FIG. 5*a*, an initial condition is illustrated, with joint 228*e* stationary but free to rotate in the plane of the paper, and end joint 228*f* free to move in any direction in the plane of the paper. FIG. 5*b* illustrates the result of motion of joint 228*f* to locations indicated as 228*f*' and 228*f*". As illustrated, the axial length of the pantograph changes in the left-right direction of arrow 510. FIG. 5*c* illustrates the result of moving free end 228*f* up and down in the direction of arrow 512 to locations 228*u* and 228*d*. Accommodation of out-of-plane differential translation and three degrees of rotational differential motion between ends of the pantograph is necessary, so the end joints 230 and 232 might be uniball joints. It has been found, however, that the structure is too limber when uniball joints are used at both end locations 230 and 232, and the flexible waveguide takes more than the desired amount of load in the middle. Adequate constraint, and therefore stiffness, is achieved by using a uniball joint at end 232 and a double-revolute joint at end 230 of the pantograph.

Pantograph arrangement 200 of FIG. 2*a* allows motion of the free end, and also allows motion of a middle location lying between the two ends. This allows the flexible waveguide to retain its limberness, while at the same time augmenting its structural stiffness.

Gruebler's equation for the degrees of freedom (DOF) of a two-dimensional device is $$DOF=3(n-1)-2f_1$$

where:

n=the number of links, in this case six bars and ground;

f=the number of revolute joints, in this case eight; and $$DOF=3(7-1)-2(8)=2DOF$$

The Gruebler equation demonstrates that the pantograph will allow the end points to move relative to one another in two directions in the plane. This insures that the ends have complete freedom relative to each other. The middle of the flexguide is constrained, however, as it can only move in proportion to the movement of the ends of the pantograph. When the ends of the pantograph are fixed, the center of the flexguide is also fixed.

Figure 6A:
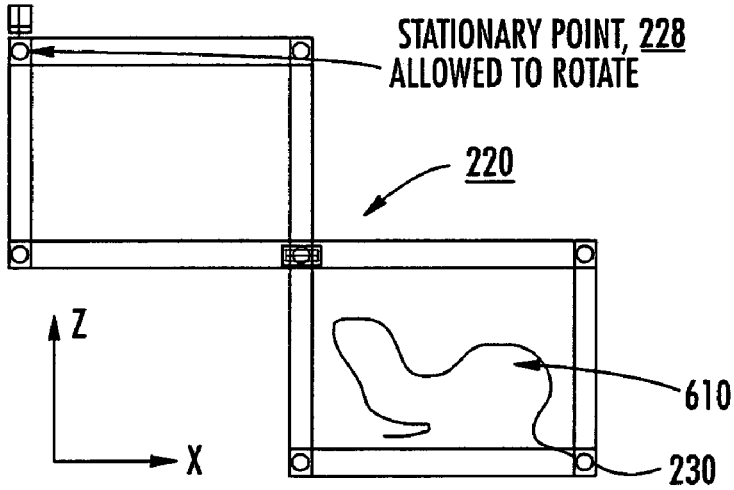
FIGS. 6*a* and 6*b* together illustrate the equivalence of a pantograph and the combination of slide and revolute joints.
Figure 6B:
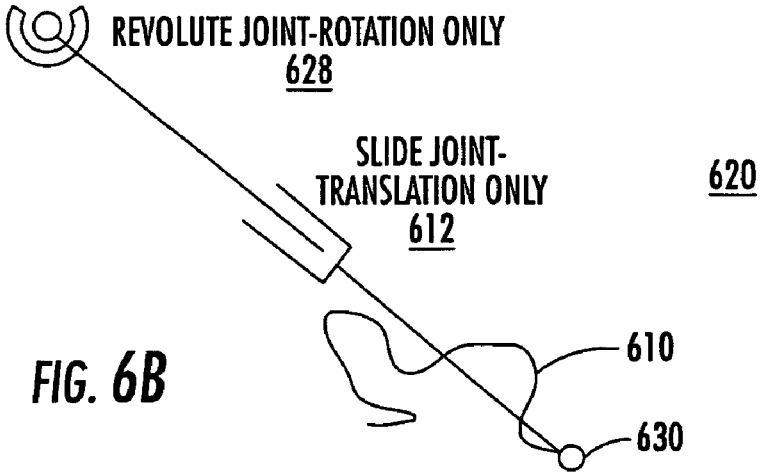

The pantograph as so far described, for stiffening the flexible connector, works by allowing motion of the free end, and also by allowing motion of a point near the middle between the two ends. This allows the flexguide to retain its limberness, while at the same time augmenting its structural stiffness. FIG. 6*a* illustrates a pantograph 220 with one end constrained at a stationary but rotatable point 228, and with the free end 230 free to move in an X-Z plane, and, with a given motion, to trace out a general two-dimensional path or FIG. 610. FIG. 6*b* shows how the pantograph 220' of FIG. 6*a* is equivalent to the combination 620 of a single-revolute joint 628 with a translation-only slide joint 612. The free end of the structure 620 of FIG. 6*b* can move in a manner equivalent to that of free end 230 of FIG. 6*a*, to trace out the same two-dimensional path or FIG. 610. Motion of an end of the pantograph 220 or its equivalent 620 out of the X-Z plane is more difficult to visualize. The double revolute joint 230 of FIGS. 2*a* and 630 of FIG. 6*b* provides stiffness to the assembly, about an axis in space defined by the end points of the uniballs, while allowing out-of-plane motion of the free end.

Figures 7A, 7B, 7C:
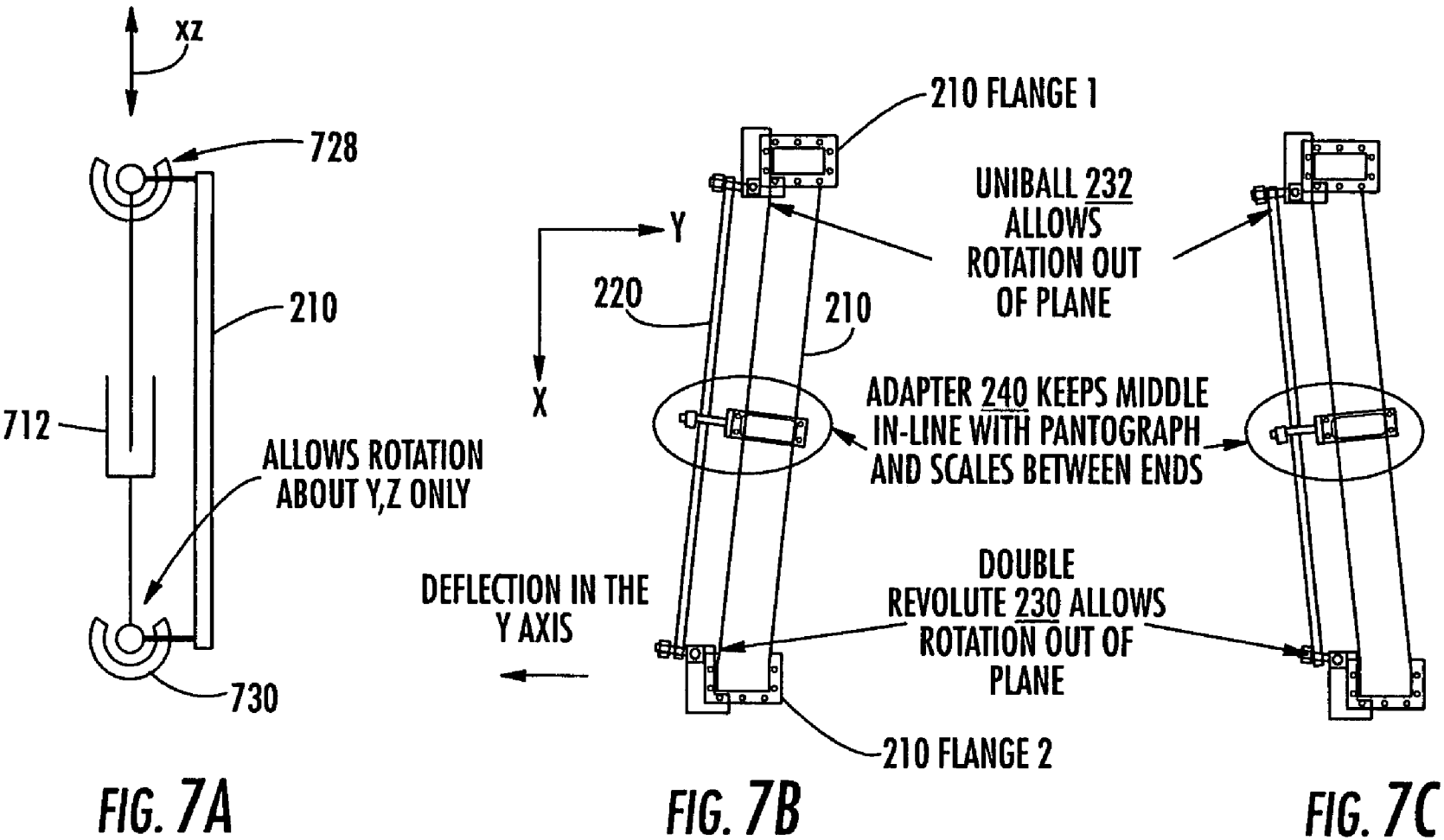
FIG. 7*a* is a simplified schematic illustration of a combination slide and revolute joint as in FIG. 6*b*, combined with a flexible waveguide.
FIG. 7*b* illustrates a pantograph with a flexible waveguide such as that of FIG. 2*a*, showing out-of-plane motion in one direction.
FIG. 7*c* illustrates the pantograph/waveguide combination of FIG. 7*b*, showing out-of-plane motion in the opposite direction.

FIG. 7*a* illustrates the pantograph equivalent 620 of FIG. 6*b* together with a simplified view in the XZ, plane of the flexguide 210. 730 allows rotation only about Y and Z. FIG. 7*b* illustrates the flexguide 210 and its flanges 210flange1 and 210flange2 in somewhat more detail, and also illustrates the pantograph 220 looking along the Z axis, to illustrate out-of-plane (as to FIG. 3) motion. As illustrated in FIG. 7*b*, adapter 240 connected to the center of the pantograph 220 deflects out of plane by an amount related to the deflection in the Y direction of double revolute joint 230 relative to uniball joint 232. FIG. 7*c* illustrates deflection in the opposite direction relative to FIG. 7*b*. The pantograph 220 keeps a firm grip on the middle of the flexguide 210 while allowing the end to go out of plane. In effect, the middle of the flexguide is "twisted," to follow along the plane defined by the pantograph. The stiffness of the pantograph bars maintains the out-of-plane motion of the middle scaled between the motion(s) of the ends.

It should be emphasized that in the discussion, the joints which define the end points of the pantograph are placed as close as is convenient to the end points of the flexguide, but some compromise is necessary since the rotatable joints cannot pragmatically occupy the same location as the center of the waveguide flange. Consequently, there may be some slight errors in the motions described and the actual physical locations of the various elements.

The analysis associated with FIGS. 6*a*, 6*b*, 7*a*, 7*b*, and 7*c* leads to a further improvement in the pantograph structure.

Figure 8B:
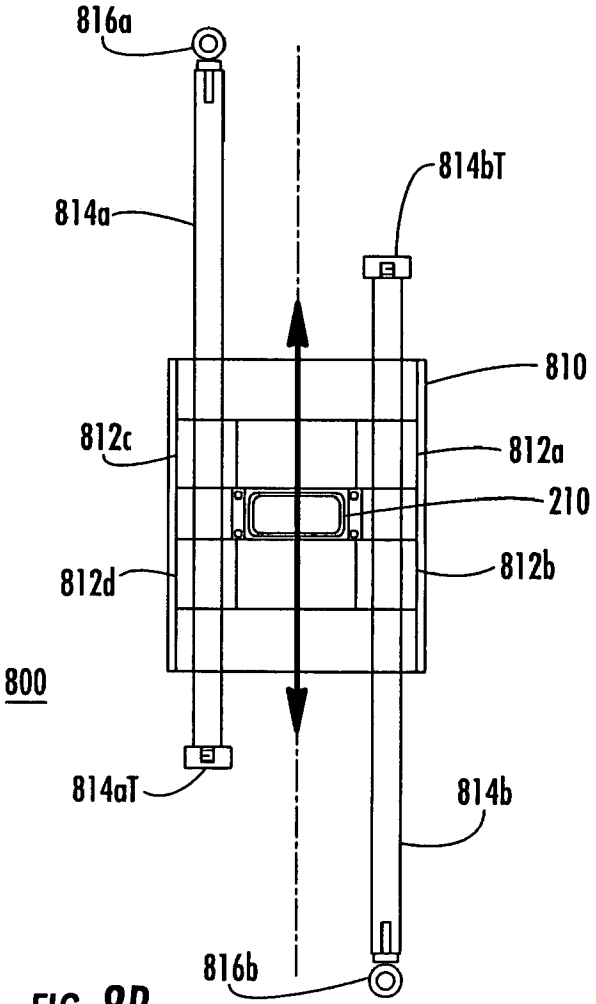
FIG. 8*b* is a corresponding plan view thereof.
Figure 8A:
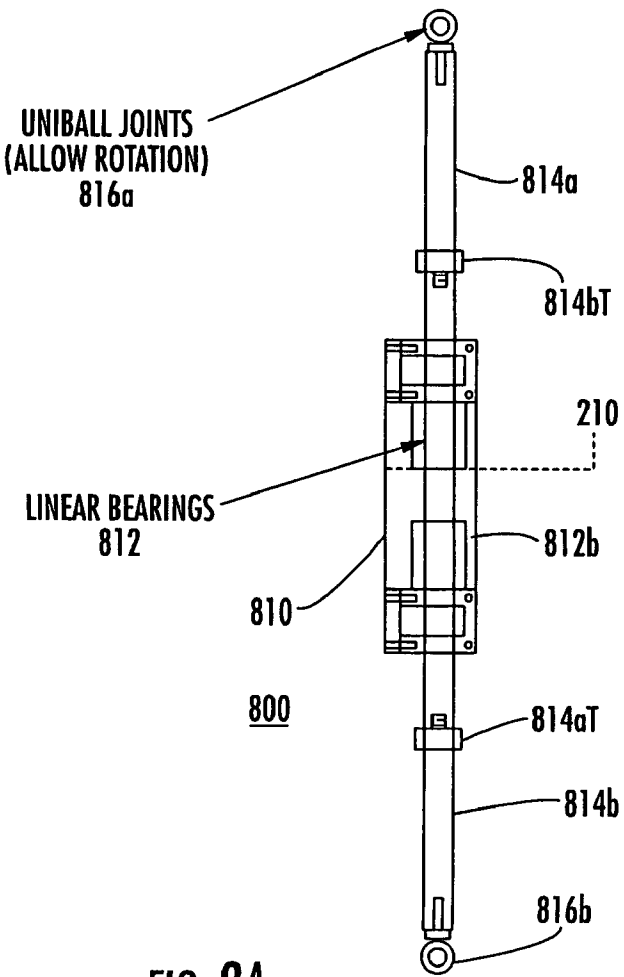
FIG. 8*a* is a simplified elevation view of a carriage and parallel bars according to an aspect of the invention.

As mentioned, the center of the flexguide of FIGS. 7*a*, 7*b*, and 7*c* moves along a line connecting the end points of the structure. FIGS. 8*a* and 8*b* illustrate two views of a "carriage-and-shaft" structure 800 including a carriage 810 mounted by way of linear bearings 812*a*, 812*b*, 812*c*, and 812*d* onto a pair of mutually parallel support shafts 814*a* and 814*b*. Shaft 814*a* is mounted to an end structure (not illustrated in FIGS. 8*a* and 8*b*) by way of a uniball joint 816*a*, and shaft 814*b* is mounted to its portion of the external structure (not illustrated) by way of a uniball joint 816*b*. Shafts 814*a* and 814*b* are maintained in a mutually parallel state or condition by the action of carriage 810. Carriage 810 can translate freely along the shafts within the limits of motion imposed by ends or stop terminations 814*a* T and 814*b* T of shafts 814*a* and 814*b*, respectively. As illustrated in FIG. 8*b*, the flexguide 210 extends through the center of the carriage, and it is easy to see that the middle of the flexguide always lies on the centerline between ends 816*a* and 816*b*. The bearings and the carriage also transfer loads between the two shafts. The performance of the flexguide is improved by the simple addition of the carriage-and-shaft arrangement 800, because the resonance is increased by support near the middle of the flexguide in addition to the ends. However, the position of the carriage is still determined by the stiffness of the flexguide. If some way were available to maintain the carriage at a location midpoint between the end points defined by joints 816*a* and 816*b*, the structure would be equivalent to that of FIG. 2*a*.

Figure 9:
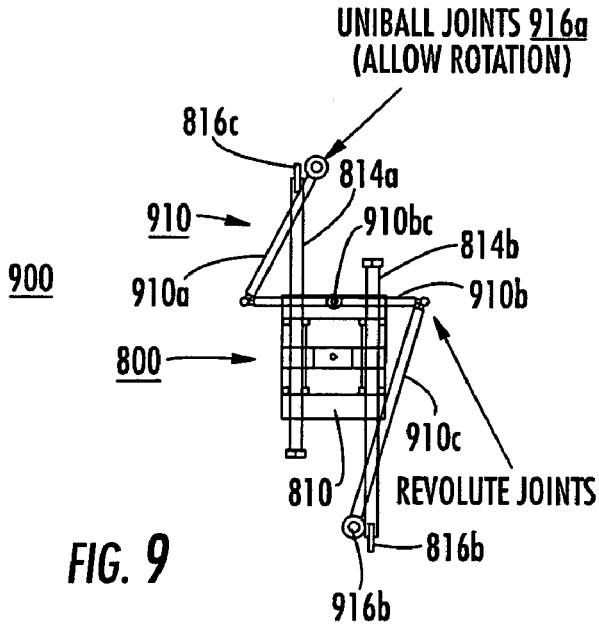
FIG. 9 is a simplified plan view of the carriage arrangement of FIG. 8, together with a bell crank arrangement.

FIG. 9 illustrates a structure 900 including a carriage-and-shaft structure 800 including a carriage 810 and parallel shafts 814*a*, 814*b* as described in conjunction with FIGS. 8*a* and 8*b*, combined with a bell crank structure 910. Bell crank structure 910 includes three arms or bars 910*a*, 910*b*, and 910*c*, having revolute joints at the juncture between bar 910*a* and 910*b*, between bar 910*b* and bar 910*c*, and fastening a location 910*bc* along bar 910*b* (which is the center of bar 910*b* in this case) to carriage 810. The ends of the bell crank structure 910 are connected to the external support structure (not illustrated in FIG. 9) by spherical or uniball joints 816*a* and 816*b*. As mentioned in regard to the structure 200 of FIG. 2*a*, the joints cannot occupy exactly the desired or theoretical positions, so some compromise is needed. In the case of structure 900 of FIG. 9, the uniball joints 816*a* and 816*b* are displaced from the end points of the shafts 814*a* and 814*b*, and the revolute joint at location 910*bc* is displaced relative to the center of the flexguide.

Figure 10A:
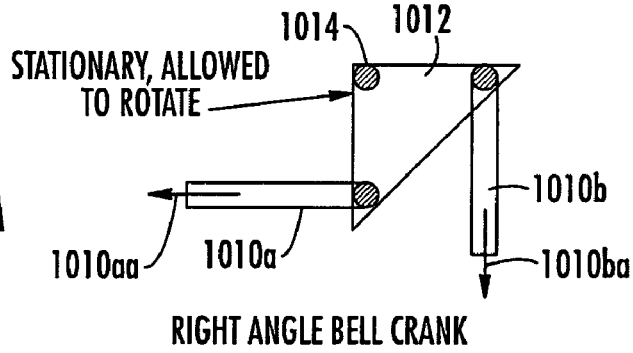
FIG. 10*a* is a simplified representation of a right-angle bell crank linkage.
Figure 10B:
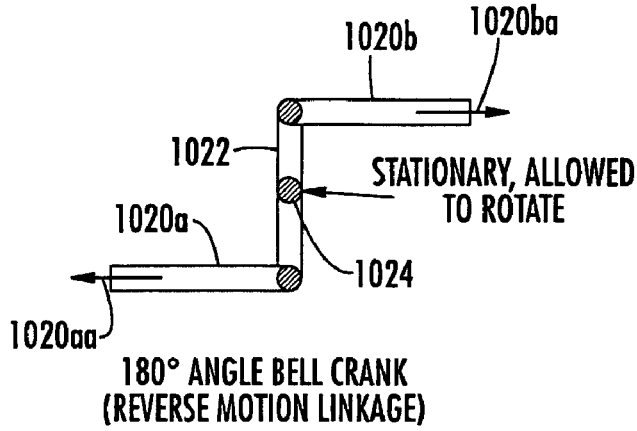
FIG. 10*b* is a simplified representation of a direction-reversing bell crank linkage.
Figure 10C:
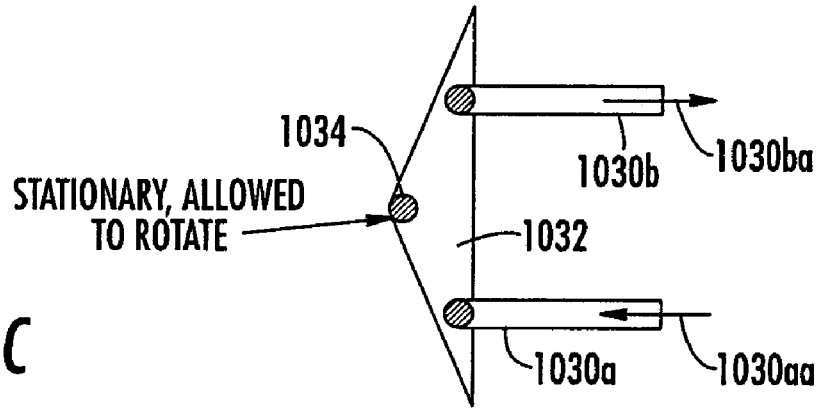
FIG. 10*c* is a simplified representation of an obtuse-angle bell crank linkage.
Figure 10D:
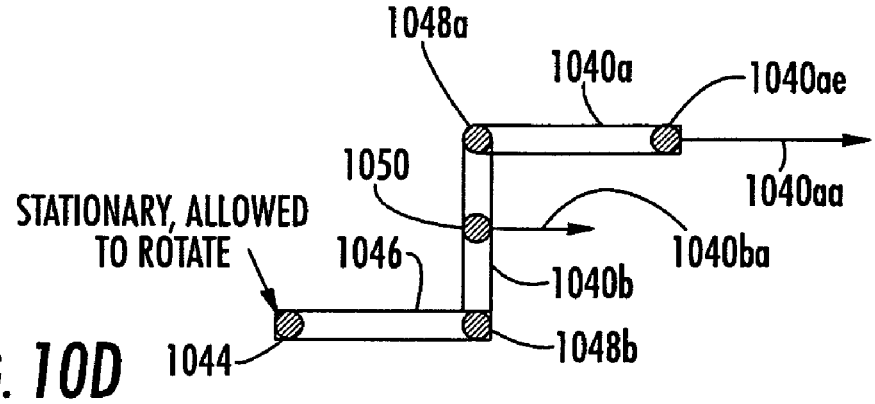
FIG. 10*d* illustrates a bell crank linkage in which proportional movement occurs.

FIGS. 10*a*, 10*b*, 10*c*, and 10*d* illustrate various conventional forms of bell cranks. In FIG. 10*a*, a right-angle bell crank includes a first bar 1010*a* and a second bar 1010*b*, both connected to locations on a member or plate 1012, mounted for rotation about a point 1014. When first bar 1010*a* is moved in the direction indicated by arrow 1010*aa*, the plate 1012 rotates, resulting in motion in the direction of arrow 1010*ba* of bar 1010*b*. In FIG. 10*b*, a 180° bell crank or reverse motion linkage includes a first bar 1020*a* and a second bar 1020*b*, each having an end connected to an end of a further bar 1022, hinged for rotation about a point 1024. When first bar 1020*a* is moved in the direction indicated by arrow 1020*aa*, bar 1022 rotates about point 1024, resulting in movement or motion of second bar 1024*b* in the direction of arrow 1024*ba*. In FIG. 10*c*, an obtuse angle bell crank includes a first bar 1030*a* and a second bar 1030*b*, each having an end connected to an end of a member or plate 1032, hinged for rotation about a point 1034. When first bar 1030*a* is moved in the direction indicated by arrow 1030*aa*, member 1032 rotates about point 1034, resulting in movement or motion of second bar 1030*b* in the direction of arrow 1030*ba*. In FIG. 1*d*, a bell crank linkage includes a first bar 1040*a* joined at a rotary or revolute joint 1048*a* to a second bar 1040*b*. The other end of second bar 1040*b* is connected at a rotary joint 1048*b* to a further bar 1046. The other end of further bar 1046 is supported at a rotary or revolute joint 1044. As illustrated, the linkage of FIG. 10*d* is under-constrained, in that for a fixed position of points 1044 and 1040*a*, there are an infinite number of positions which the links can take. If, however, motion at point 1050 is constrained to lie on a horizontal line, motion of the end 1040*ae* of bar 1040*a* in the direction of arrow 1040*aa* causes a proportional movement of a point 1050 along the length of bar 1040*b*, as suggested by arrow 1040*ba*. Thus, pulling end 1040*ae* of bar 1040*a* results in proportional movement of midpoint 1050.

Figure 11A:
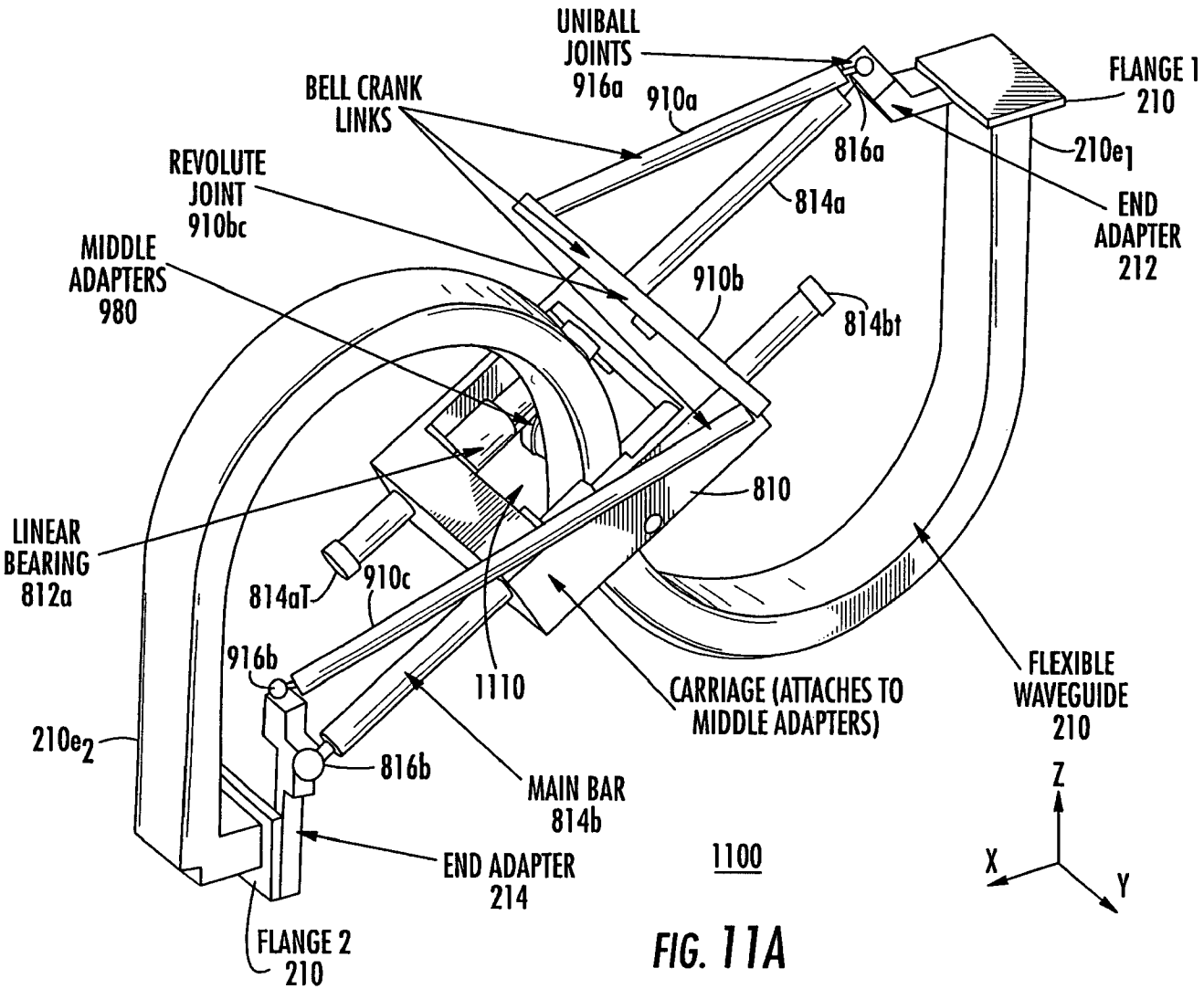
FIG. 11*a* is a simplified perspective or isometric view of a carriage-and-shaft/bell-crank arrangement according to an aspect of the invention.
Figure 11B:
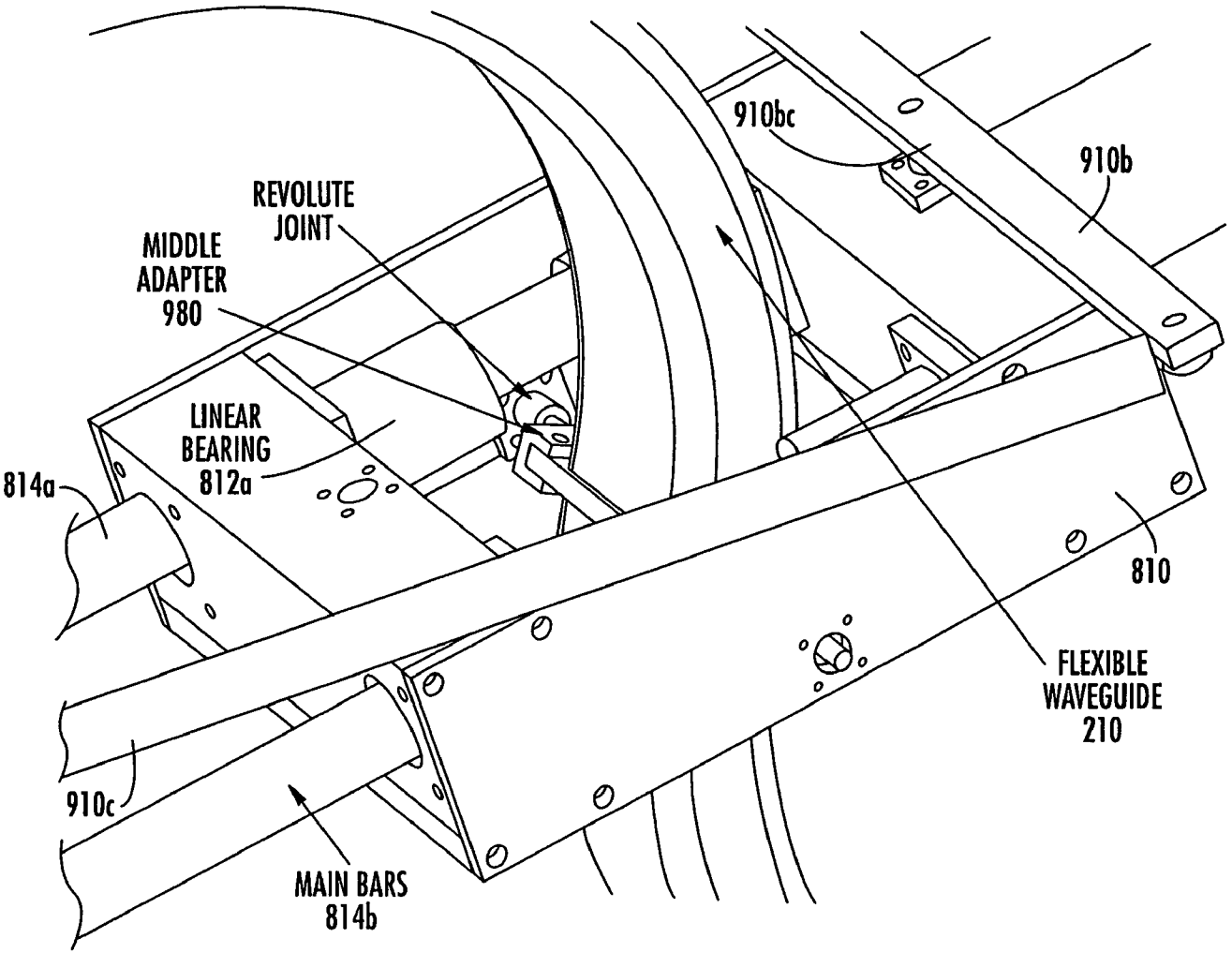
FIG. 11*b* is a detail thereof.

FIGS. 11*a* and 11*b* are perspective or isometric views of a combination of a carriage-and-shaft arrangement and bell crank, a "bell-crank-and-carriage" arrangement (structural augmentation bell crank) 1100 according to an aspect of the invention, equivalent to the pantograph arrangement 200 of FIG. 2*a*. Elements exactly equivalent to those of FIG. 2*a* are designated by the same reference alphanumerics. In FIGS. 11*a* and 11*b*, the flexible waveguide 210 has a sinusoidal shape, as in FIG. 2*a*. The center of the flexible waveguide 210 extends through an aperture 1110 in carriage 810, and is held by a middle adapter arrangement 980 having a single revolute joint. That end of main shaft or bar 814*a* remote from end 814 at is connected by a uniball joint 816*a* to end adapter 212, and that end of main shaft 814*b* remote from end 814*bt* is similarly connected by a uniball joint 816*b* to end adapter 214. Shafts 814*a* and 814*b* are maintained mutually parallel by the action of carriage 810. The position of carriage 810 is maintained approximately centered between the ends 816*a* and 816*b* by a bell crank arrangement including shafts or bars 910*a*, 910*b*, and 910*c*. That end of bar 910*a* remote from the connection to bar 910*b* is connected by a uniball joint. 916*a* to end adapter 212, and that end of bar 910*c* remote from bar 910*b* is connected by a uniball 916*b* to end adapter 214. As mentioned, the joints cannot occupy the same space, so the positioning of the various elements does not achieve theoretical perfection. Bar 910*b* is connected to a "central" location on carriage 810 by a revolute joint 910*bc*. In operation, relative rotational motion between end adapters 212 and 214 results in rotation of the carriage-and-shaft/bell-crank arrangement relative to the end adapters. Extension or compression of the distance between end adapters is accommodated by corresponding extension or compression of the carriage-and-shaft/bell-crank arrangement.

In the arrangement 1100 of FIGS. 11*a* and 11*b*, the length of the flexguide 210 is based on the required range of motion. With current materials and configurations, the flexguide itself has a natural frequency lower than the range of excitation frequencies in the desired application.

Figure 12C:
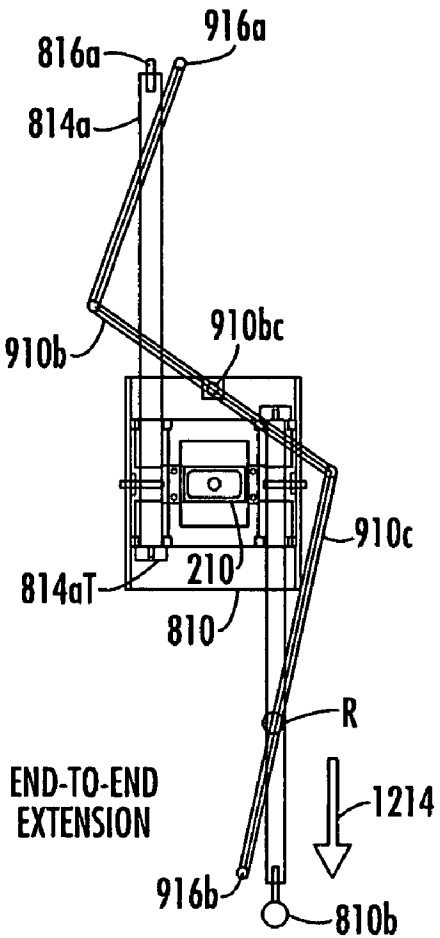
FIGS. 12*a*, 12*b*, and 12*c* represent the carriage-and-shaft/bell-crank arrangement of FIGS. 11*a* and 11*b* at various extensions.
Figure 12B:
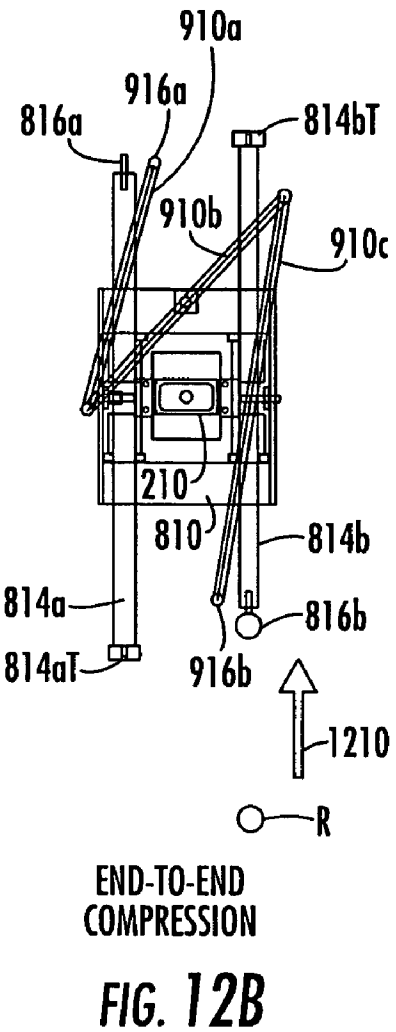
Figure 12A:
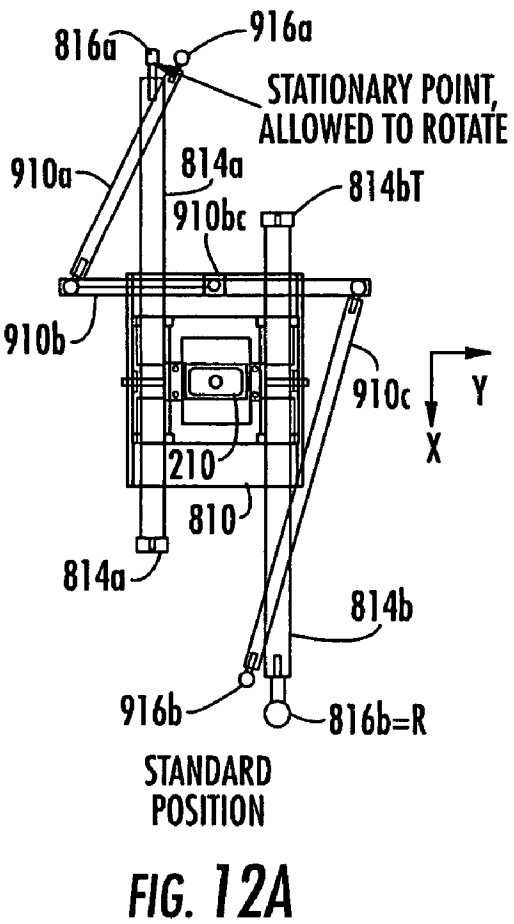

FIGS. 12*a*, 12*b*, and 12*c* illustrate a reference position and compression and extension two-dimensional motions, respectively, of the bell-crank-and-carriage arrangement (structural augmentation bell crank arrangement) 1100 of FIG. 11. In FIG. 12*a*, the structure is in a standard position, with joint 816*b* at a reference position R relative to joint 81.6*a*. As can be seen, the carriage 810 lies roughly midway between the stops 814*a* T and 814*b* T on the parallel shafts 814*a* and 814*b*, respectively, and the flexguide 210 lies on a line extending between joints 816*a* and 816*b*. FIG. 12*b* illustrates by an arrow 1210 motion of joint 816*b* away from reference point R, with the result that the structure compresses, but the flexguide 210 continues to lie on a line extending between joints 816*a* and 816*b*. FIG. 12*c* shows extension of the structure by motion of joint 816*b* in the direction of arrow 1214 relative to point R. Flexguide 210 continues to lie on a line extending between joints 816*a* and 816*b*.

Figure 13B:
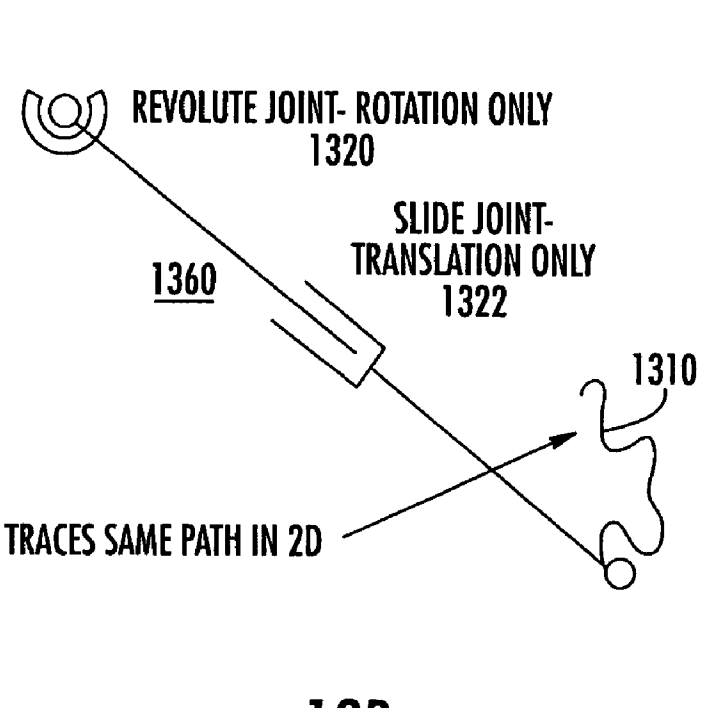
FIGS. 13*a* and 13*b* together illustrate the equivalence of a revolute-joint/slide-joint to a carriage-and-shaft/bell-crank arrangement.
Figure 13A:
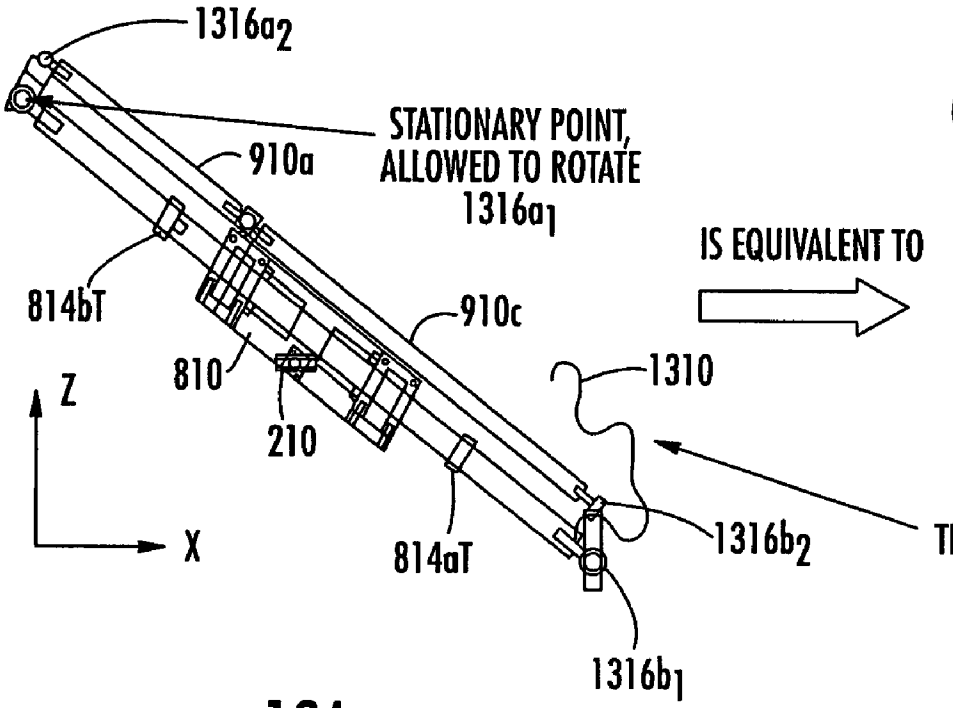

The structural augmentation bell crank arrangement 1100 of FIG. 11 operates by allowing motion of the free end, and also allowing motion of a point near the middle between the two ends. This allows the flexguide to retain its limberness, while at the same time augmenting its structural stiffness. This is accomplished by additional mid-span constraint. FIGS. 13*a* and 13*b* illustrate the correspondence of the arrangement of the bell-crank-and-carriage arrangement of FIG. 11 with the combination of a revolute joint and slide-joint for translation. In FIG. 13*a*, elements corresponding to those of FIGS. 9 and 11 are given the same designations. In FIG. 13*a*, one end of the structure at location 1316*a*1 is allowed to rotate in the two-dimensional plane of the illustration. The structure as a whole is compressible and extensible, as described in conjunction with FIGS. 12*b* and 12*c*, so the free end (joint 1316*b*2, for example) is free to trace out a random two-dimensional path or FIG. 1310. The equivalent structure 1360 of FIG. 13*b* includes a revolute joint 1320 and a slide joint 1322, and it is capable of tracing out the same random two-dimensional pattern 1310. Consequently, the bell-crank-and-carriage arrangement is equivalent to the structure of FIG. 13*b*, at least insofar as two-dimensional motion is concerned. More particularly, the only unresisted degree of freedom afforded the peripheral adapter of the pantograph is one degree of rotation about an axis normal to the plane of the pantograph. When attached to the bell-crank carriage, the peripheral adapter posses two degrees of rotation freedom unresisted by the carriage, namely one degree of freedom about an axis parallel to the plane of the two parallel shafts but orthogonal thereto, and a second degree of freedom in rotation about an axis defined by the two uniballs attached to the ends of the extensible parallel shafts.

Figures 14A, 14B, 14C:
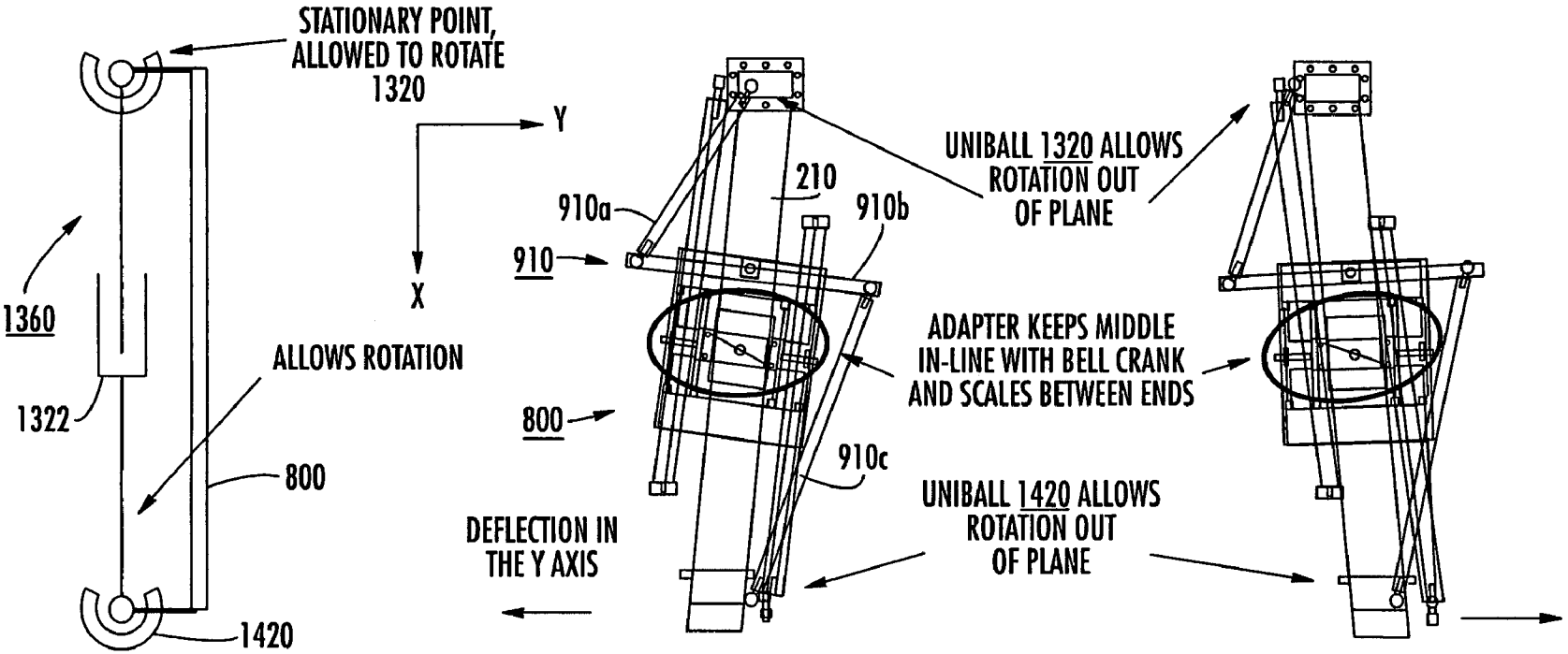
FIG. 14*a* is a simplified representation of a revolute-joint/slide-joint combination in conjunction with a flexible waveguide.
FIGS. 14*b* and 14*c* illustrate out-of-plane movement of the carriage-and-shaft/bell-crank arrangement.

FIGS. 14*a*, 14*b*, and 14*c* together illustrate out-of-plane motions of the structural augmentation bell crank-arrangement. FIG. 14*a* illustrates a structure 1360 equivalent to that of FIG. 13*b*, with the addition of a second revolute joint 1420: and a simplified representation of the carriage-and-bar arrangement 800. FIGS. 14*b* and 14*c* illustrate deflection out of the plane (in the direction of the Y axis) of the end of the structure bearing uniball joint 1420. As illustrated, the flexguide 210 is maintained by the adapter in-line with the bell crank 900 and at a location scaled between the ends of the structure. Uniball joints 1320 and 1420 allow motion out of the plane.

Deformations in six degrees of freedom (6 DOF) can be accommodated by a structure according to an aspect of the invention.

Other embodiments of the invention will be apparent to those skilled in the art. For example, while the structural augmentation as described is affixed to the augmented structure (the waveguide) at a single location remote from the ends, any number of attachments can be used, and their spacing may be equal or nonequal, depending upon the ratio of motion of the various parts to the total motion between ends. If a single attachment to the enhanced structure is used, it may be at a location away from the center of the structure. A pantograph or bell crank may have more nodes than those illustrated.

A mechanical system (200, 1100) according to an aspect of the invention comprises first (12) and second (14) separate objects. The first (12) and second (14) objects are subject to recurrent relative motion therebetween. In one embodiment of this aspect of the invention, the first (12) and second (14) objects are an antenna and a transmitter, respectively. A flexible connection (16, 210), which in one embodiment is a rectangular waveguide connection, includes a first end (210*e*1) physically connected to the first object (12) and a second end (210*e*2) physically connected to the second object (14). The flexible connection or waveguide (210) is subject to failure due to fatigue attributable to the recurrent motion and/or vibration or due to mechanical resonance within the range of frequencies of the excitation. The mechanical system (200, 1100) includes one of (a) a pantograph (220) and (b) a bell-crank-and-carriage arrangement (900). The one of the pantograph (220) and a bell-crank-and-carriage (900) arrangements includes a first end (210*e*1) physically connected to the first object (12) and a second end (210*e*2) physically connected to the second object (14). The one of the pantograph (220) and a bell-crank-and-carriage (900) arrangements also includes an attachment portion (240*a*; 980) exhibiting a motion intermediate the relative motion. The mechanical system (200; 1100) also includes a physical connection between the attachment portion (240; 980) of the one of the pantograph (220) and a bell-crank-and-carriage arrangements (1100) and the exterior of the middle of the flexible connection (210) or waveguide connection. In a particular version of one aspect of the invention, the first and second separate objects are independently supported, and the one of the pantograph and bell-crank-and-carriage arrangements does not support either object. In one embodiment of this aspect of the invention, the attachment portion lies approximately midway between the first and second ends.

What is claimed is:

1. A mechanical system, comprising:

first and second separate objects, said first and second objects being subject to recurrent relative motion therebetween;

a flexible rectangular waveguide connection including a first end physically connected to said first object and a second end physically connected to said second object, said waveguide connection being subject to failure due to fatigue attributable to said recurrent motion;

one of a pantograph and a ball-crank-and-carriage arrangements, said one of said pantograph and a ball-crank-and-carriage arrangements including a first end physically connected to said first object and a second end physically connected to said second object, said one of said pantograph and a ball-crank-and-carriage arrangements also including an attachment portion exhibiting a motion intermediate said relative motion, for causing said attachment portion to move in an amount intermediate the motion of said first and second ends of said one of said pantograph and said ball-crank-and-carriage arrangements; and a physical connection between said attachment portion of said one of said pantograph and a ball-crank-and-carriage arrangements and the exterior of the middle of said waveguide connection.

2. A mechanical system according to claim 1, wherein said attachment portion lies approximately midway between said first and second ends.

3. A mechanical system, comprising:

first and second separate objects, said first and second objects being subject to recurrent relative motion therebetween within a given range of motion;

a flexible connector including a first end physically connected to said first object and a second end physically connected to said second object, said flexible connector being subject to failure due to fatigue attributable to said recurrent motion;

a pantograph including a first end physically connected by means of a spherical connection to said first object and a second end physically connected by means of a double revolute joint to said second object, said pantograph also including an attachment portion exhibiting a motion intermediate said relative motion, for causing motion of said attachment portion proportional to the separation of said attachment portion from said first and second ends of said pantograph; and a physical connection between said attachment portion of said pantograph and the exterior said flexible connector.

4. A mechanical system according to claim 3, wherein said attachment portion of said pantograph lies midway between said first and second ends of said pantograph, and said physical connection is to the middle of said flexible connector.

5. A mechanical system according to claim 3, wherein joints other than said spherical and double revolute joint are revolute.

6. A mechanical system, comprising:

first and second separate objects, said first and second objects being subject to recurrent relative motion therebetween within a given range of motion;

a flexible connector including a first end physically connected to said first object and a second end physically connected to said second object, said flexible connector being subject to failure due to fatigue attributable to said recurrent motion;

a bell-crank-and-carriage arrangement including a first end physically connected to said first object and a second end physically connected to said second object;

physical connection means connected between said carriage of said bell-crank-and-carriage arrangement and corresponding selected locations on said flexible connector, wherein each of said selected locations on said flexible connector is spaced from other selected locations on said flexible connector; and wherein said flexible connector is a rectangular waveguide.

7. A mechanical system, comprising:

first and second separate, individually supported objects, said first and second objects being subject to recurrent relative motion therebetween within a given range of motion;

a flexible connector including a first end physically connected to said first object and a second end physically connected to said second object, said flexible connector being subject to failure due to fatigue attributable to said recurrent motion;

one of (a) a bell-crank-and-carriage and (b) a pantograph, said one of said bell-crank-and-carriage and said pantograph including a first end physically connected to said first object and a second end physically connected to said second object, said one of a bell-crank-and-carriage and pantograph providing no support for either of said first and second objects;

physical connection means connected between selected locations of said one of said bell-crank-and-carriage and pantograph and corresponding selected locations on said flexible connector; and wherein said first end of said one of (a) a bell-crank-and-carriage and (b) a pantograph is connected to said first object by a spherical joint and said second end of said one of (a) a bell-crank-and-carriage and (b) a pantograph is connected to said second object by means of a double revolute joint.

8. A mechanical system according to claim 7, wherein said one of (a) a bell-crank-and-carriage and (b) a pantograph is a multimode pantograph and joints within said multimode pantograph are single revolute joints.

9. A mechanical system according to claim 7, wherein said one of (a) a bell-crank-and-carriage and (b) a pantograph is a bell-crank-and-carriage, and said bell-crank-and-carriage includes a carriage and first and second mutually parallel bars, and one end of said first parallel bars is connected to said first object by a spherical joint, and one end of said second parallel bar is connected to said second object by a spherical joint.

10. A mechanical system according to claim 9, wherein said carriage includes a sliding joint associated with each of said first and second parallel bars.

11. A mechanical system according to claim 10, wherein said bell-crank-and-carriage includes a bell crank coupled to said carriage and to said first and second objects.

12. A mechanical structure, comprising;

first and second separate objects, said first and second objects being subject to recurrent relative motion therebetween;

a flexible connector including a first end physically connected to said first object and a second end physically connected to said second object;

first and second elongated mutually parallel members, said first member defining a first end rotatably connected to said first object, and said second member defining a first end rotatably connected to said second object;

means for slidably connecting a selected location along said flexible connector to said first and second elongated members; and means for causing said selected location along said flexible connector to move in an amount approximately proportional to the differential motion between said first and second objects.

13. A mechanical structure according to claim 12, wherein said means for slidably connecting comprises a carriage running on said first and second elongated members.

* * * * *